United States Patent [19]

Ohno

[11] 4,280,302

[45] Jul. 28, 1981

[54] GRINDING METHOD AND APPARATUS

[76] Inventor: Ietatsu Ohno, 1-2, 1-chome, Kasuya, Setagaya-ku, Tokyo, Japan

[21] Appl. No.: 957,673

[22] Filed: Nov. 6, 1978

[51] Int. Cl.[3] ..... B24B 31/08

[52] U.S. Cl. ..... 51/7; 51/317; 51/318

[58] Field of Search ..... 51/6, 7, 17, 19, 317, 51/318

[56] References Cited

U.S. PATENT DOCUMENTS

| | | | |
|---|---|---|---|
| 464,584 | 12/1891 | Patterson | 51/19 |
| 2,218,353 | 10/1940 | Gruenberg | 51/7 |
| 2,827,740 | 3/1958 | Lee | 51/7 |
| 2,912,803 | 11/1959 | Simjian | 51/7 X |
| 3,570,183 | 3/1971 | Ferrara | 51/7 |
| 3,599,374 | 8/1971 | Porter | 51/19 X |
| 3,623,278 | 11/1971 | Schwartz | 51/7 X |
| 4,034,515 | 7/1977 | Ohno | 51/7 |

FOREIGN PATENT DOCUMENTS

| | | | |
|---|---|---|---|
| 523325 | 3/1956 | Canada | 51/19 |

*Primary Examiner*—Gary L. Smith
*Attorney, Agent, or Firm*—Laurence R. Brown

[57] ABSTRACT

A grinding method characterized in that a rotatably arranged grinding tank and downward projecting spindles rotatable in any direction on a stationary or rotatable main shaft stand positioned above the grinding tank and fitted to a fitting column body are provided, the grinding tank is charged with such grinding materials as hone grains and is stopped or rotated at a low or high speed depending on the work product. The work product to be ground is fitted to the spindle on the main shaft stand, is put into the grinding materials within the tank and is rotated reversely to or in the same direction as of the rotation of the grinding tank or is stopped and the work or the grinding tank is moved up and down and forward and rearward so that the work may be ground in a low pressure fluid state or high pressure fluid state. The tank is sealed to permit high grinding pressures when the tank and work products are rotated at high speeds.

6 Claims, 8 Drawing Figures

GRINDING METHOD AND APPARATUS

BACKGROUND OF THE INVENTION

1. Field of the Invention

This invention relates to a grinding method and apparatus for making such rough or precise surface-grinding as the pre-plating, buff-grinding or protrusion-removing of production parts, industrial parts and tools, articles and domestic hardware.

2. Description of the Prior Art

Such grinding has been conventionally carried out by a buff-grinding or paper-grinding. However, even though small and straight things can be thereby ground, large or deformed parts are limited in the grinding contact surface in the conventional grinding method. Bent surfaces and those having a grinding direction, are difficult to grind and are therefore ground by hand or with a buff at a very low efficiency (For example, U.S. Pat. No. 3,474,574).

SUMMARY OF THE INVENTION

An object of the present invention is to provide a grinding method and apparatus wherein the characteristics are quite different from those of such conventional buff-grinding method and other conventional grinding methods and a work to be ground is enclosed with grinding materials about the profile and contour. The work product is made to slide and rotate centrifugally so as to be able to be ground in a wide range of conditions from a low speed fluid system to a high speed and high density pressure fluid system when the tank is sealed.

DETAILED DESCRIPTION OF PREFERRED EMBODIMENTS

Figure 1:
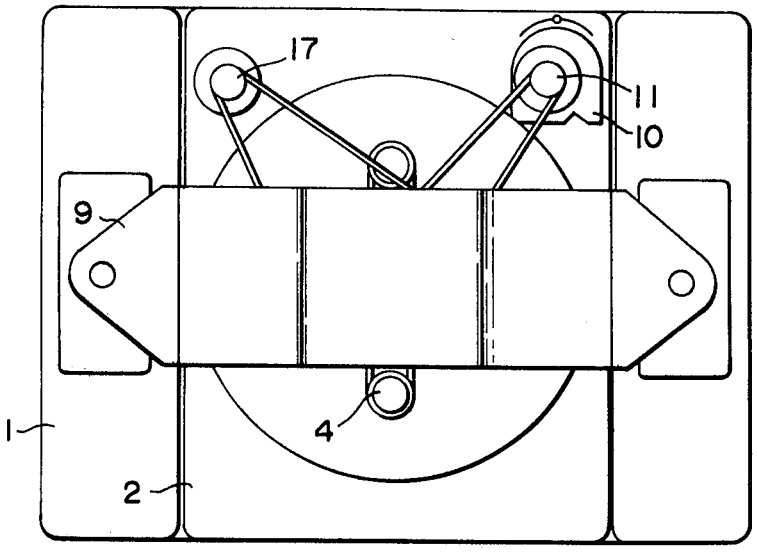
FIG. 1 is a plan view showing an embodiment of the grinding apparatus for working the method of the present invention.
Figure 2:
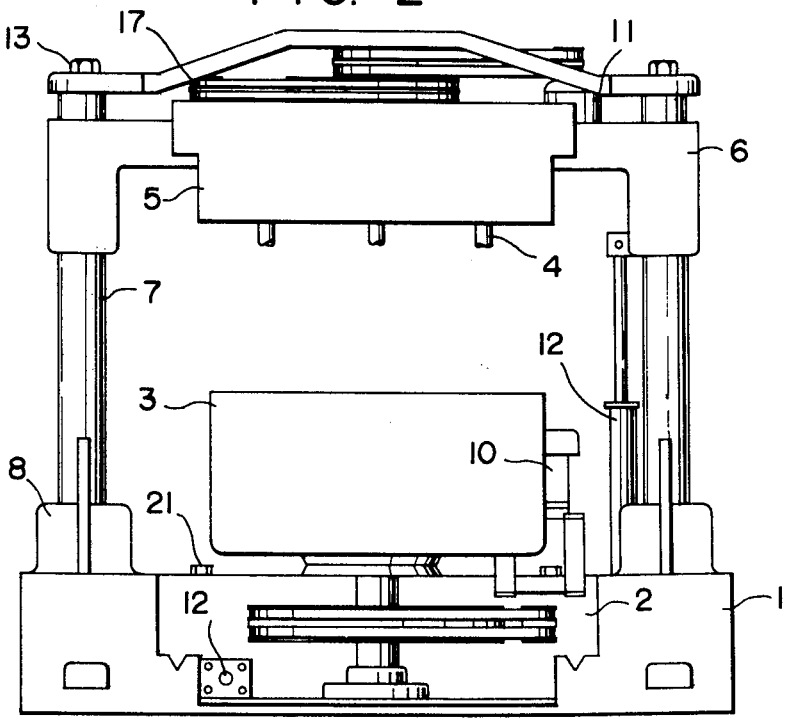
FIG. 2 is an elevation of FIG. 1.
Figure 3:
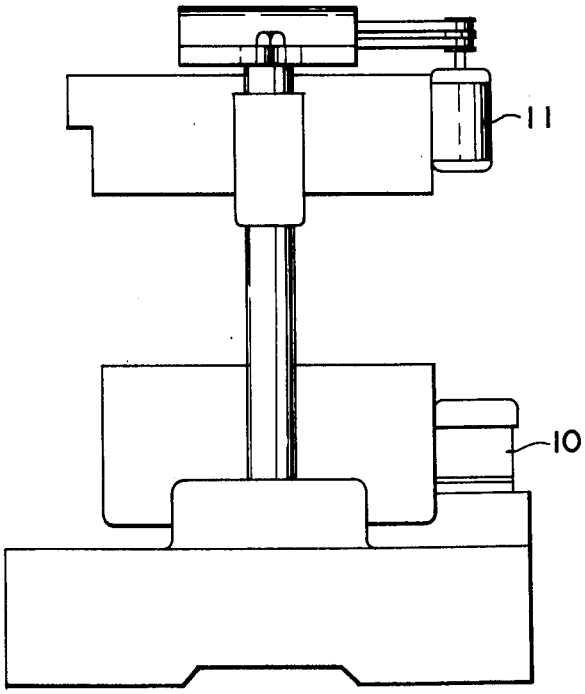
FIG. 3 is a side view of FIG. 1.

FIG. 1 is a plan view showing a grinding apparatus for achieving the method of the present invention, FIG. 2 is an elevation of the same and FIG. 3 is a side view of the same.

In the drawings, reference numeral 1 indicates a grinder body and a bed body 2 is fitted movably forward and rearward on a groove provided on the body 1. 3 is a vertical rotary grinding tank of any shape such as a circular, polygonal or conical shape fitted on the above mentioned bed body 2. 4 is a spindle projecting downward as opposed to the above mentioned grinding tank 3 and rotatably fitted to a main shaft head 5 fitted to a main shaft stand column body 6 slidably held by two supporting pillars 7 erected on a frame 8 on the grinder body 1 and connected and held at the upper ends by an arch frame 9. The grinding tank 3, spindle 4 and main shaft stand 5 are made rotatable at any speed in any direction respectively by a grinding tank rotating motor driving device 10, spindle rotating motor driving device 11 and main shaft stand rotating motor driving device 17. The column body 6 slides up and down the supporting pillars 7 with a hydraulic device 12.

In such respect, the grinding method of the present invention shall be explained in the following discussion.

Figure 4:
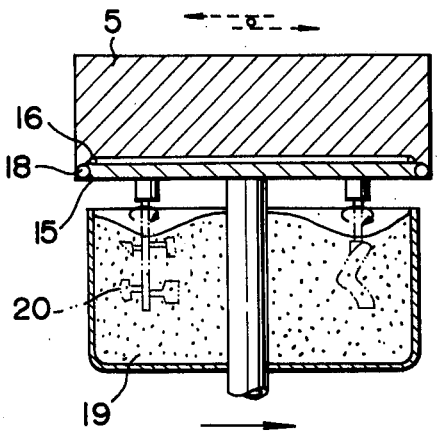
FIG. 4 is an explanatory view of a low speed pressure spin fluid grinding.

(A) Case of a low speed pressure spin fluid grinding (fine grinding and low pressure grinding):

As shown in FIG. 4, a work 20 to be ground is fitted to the spindle 4 and the main shaft head 5 is lowered to a proper position by the hydraulic device 12 while rotating the work 20. On the other hand, the grinding tank 13 charged with grinding materials 19 is rotated at a low speed around the work 20 or is stopped. The spindle 4 of the main shaft head 5 fitted with the work 20 will rotate as embedded in the grinding materials 19 while spinning at a speed usually higher than the number of revolutions of the grinding tanks 3 to grind the work. By the way, as required, the column body 6 is moved up and down with the hydraulic device 12 to move the work 20 up and down.

Figure 5:
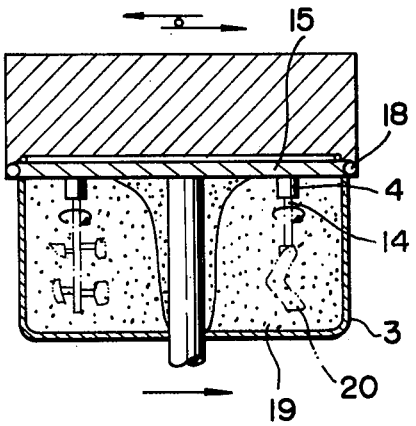
FIG. 5 is an explanatory view of a high speed and high density hone flow pressure fluid grinding.

(B) Case of a high speed and high density hone grain pressure fluid grinding (strong grinding and mirror surface luster-grinding):

As shown in FIG. 5, when the work 20 is fitted to the spindle 4 and the main shaft head 5 is lowered while rotating the work, the work 20 will move into the grinding tank. The grinding tank 3 charged with the grinding materials 19 for the object is below the main shaft head 5. A rotary disk packing seal 15 formed is provided between the upper surface of the grinding tank 3 and the lower surface of the main shaft head 5 so that the grinding materials 19 within the tank may not spring and leak out due to the action of the torque of the grinding tank 3. The lowering of the main shaft head 5 may stop in the position in which the tank contacts the packing seal 15. Therefore, the surface of the disk packing seal 15 will contact the upper surface of the grinding tank 3 so that the packing seal disk 15 and tank 3 may make the same rotation. Thus, the grinding materials 19 may be prevented from leaking out and the high pressure may generate a flow of the materials about the object. Reference numeral 14 indicates a collet chuck for fitting the work 20 to the spindle 4. 16 is a thrust ball and 18 is a packing seal.

Then the grinding tank 3 charged with the grinding materials (hone grains) 19 is rotated at a high speed with the driving device 10. Then, a centrifugal force will act within the tank and the grinding materials 19 within the tank will be pressed against the inside wall of the tank 3 by the action of the centrifugal force so as to flow rotarily around the work 20 at a high peripheral velocity in close contact uniformly both above and below.

Thus the work 20 in the flow of the grinding materials making a high peripheral speed rotation while the spindle 4 of the main shaft head 5 fitted with the work 20 is being rotated at any number of revolutions adapted to the work, from a low speed to a high speed through the motor driving device 11. Thus the object will be pressed against the grinding materials while spindle-rotating. At this time, together with the high speed and high density hone grain pressure flow and the spin flow, both concave and convex parts will be ground at a high precision and high efficiency. Further, as required, the work 20 is moved up and down.

According to this method, the grinding will be completed in about 3 to 10 minutes. At this time, if fine cutting grinding or luster-grinding materials are selected and used for the grinding materials, a precision-grinding and a luster-grinding and mirror surface grinding the same as or higher than the present grinding will be able to be made. Further, in case a strong grinding is required, if rough finishing hone grains are selected and used, a heavy grinding, strong protrusion removal or cast surface rough finish will be able to be made the same as in selecting a fine buff-grinding or blue bar buff-grinding finish, for example, from a rough sand buff-grinding.

Thus, the action in such wide range as of a low speed to high speed centrifugal force flow of grinding material, up-and-down motion, spin flow and rotary motion is possible. The difference and ratio of the rotations of the grinding tank, main shaft head and spindle can be set freely in the structure. The rotation can be made in the normal or reverse direction and can be stopped as required.

Further, depending on the material and object of the work to be ground, a wet grinding or dry grinding can be freely made. For example, the grinding of several hundreds of rouge caps shaped of a brass material will be completed in one step in such short time as 5 minutes. For grinding long parts, a receiving jig provided with a core is formed in a forward position on the line of the spindle core to prevent the work from being shaken and dropped and to fit it.

Figure 6:
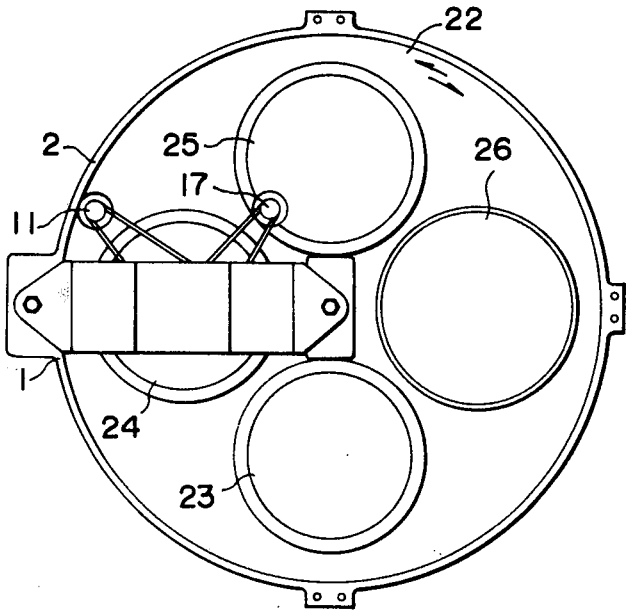
FIG. 6 is a plan view showing another embodiment of the apparatus of the present invention.

FIG. 6 is a plan view showing another embodiment for working the grinding method of the present invention in the case that a multi-object grinding is made by one chucking (works for 2 or 3 objects are ground in one cycle), that is to say, in the case that, when the work products are very different in the material condition and working object surface, for example, the rough surface is finished to high precision.

As shown in the drawing, a plurality of the above mentioned vertical rotary grinding tanks are arranged on the same periphery of a circular rotary bed 22 rotated by a motor driving device (not illustrated) so as to be respectively the first grinding tank 23, second grinding tank 24 and third grinding tank 25. The tanks are charged with grinding materials for the respective objects, that is, for example, the first grinding tank 23 is charged with rough grinding materials, the second grinding tank 24 with medium grinding materials and the third grinding tank 25 with precision finishing and luster-finishing grinding materials and the grinding tanks are stopped or rotated through the motor driving device as required.

Figure 7:
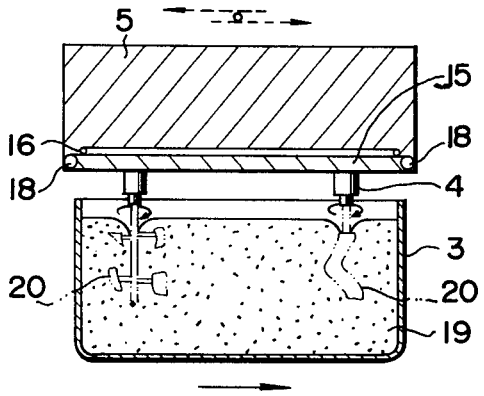
FIG. 7 is a grinding explaining view of a grinding tank as rotating at a low speed or as stopped.
Figure 8:
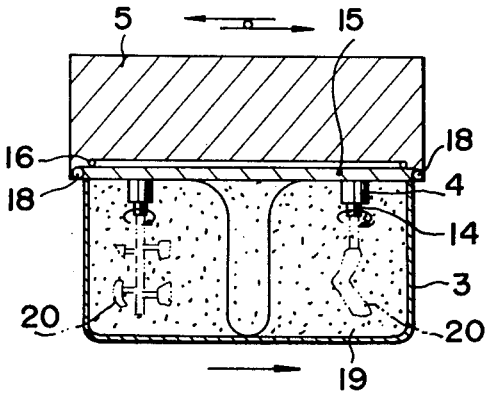
FIG. 8 is a grinding explaining view of the tank as rotating at a high speed.

On the other hand, a downward projecting spindle rotatable in any direction is provided on a main shaft stand held vertically slidable by supporting pillars in the same manner as is explained above as positioned above one of the grinding tanks. The work is fitted to the spindle, is first inserted into the first grinding tank 23 by the vertical movement of the main shaft stand and is stopped or rotated depending on the object so as to be ground. Then, depending on the working step, the bed body 22 is rotated in turn so as to continue the grinding to the second grinding tank 24 and further to the third grinding tank 25. In such case, as also explained above, the grinding should be made, in the case of a low speed pressure spin fluid grinding, when the main shaft head 5 has lowered to a proper position as shown in FIG. 7. And in the case of a high speed rotation high density hone grain pressure fluid grinding occurs when the main shaft head 5 has closely contacted the layer 3 of the grinding materials as shown in FIG. 8 so that the grinding materials within the tank may not leak out. Two or more main shaft heads 5 can be provided to increase the working cycles.

Thus, with one chucking the rough grinding takes place in the first grinding tank, the medium grinding in the second grinding tank and the precision-finish and luster-finish in the third grinding tank. Further, in the case of the automation, if the grinding time is set to be proper for each station, a series of grindings may be automatic.

Such ground finished parts as, for example, modified parts, large parts and super precision parts including such consumer articles as hygienic device plugs, hygienic pipes and table-ware, automobile parts, bicycle handles, motorcyle handles, motorcycle muffler pipes, gasoline tanks, bumpers, transmission gears, engine parts, precision devices as rotors for coolers and compressors, and all shaped articles can be finished the same as by the paper-finishing and buff-finishing grinding, can be hair line-ground and can be further luster-ground and mirror surface-ground for the plating pre-treatment.

In such prior art grinding, even with an automatic buffing apparatus which could not be automated, due to the limited contact surface and the produced grinding direction, modified articles required large sums for jigs and equipments for the grinding and yet no proportional effects were obtained. Even if any other grinder is used, the work products to be ground will rub each other, large articles will not be able to be ground, therefore hand-work will have to be used and a buff-finish or paper-finish will have to be made the same as a hand-finish at present. The present invention has solved these problems, has made the mechanization and automation of such grinding possible and has the effect that parts in a wide range of small to large articles and modified articles can be ground in one chucking and in multi-steps for multi-objects.

I claim:

1. A grinding method comprising in combination, filling a tank rotatable about a central axis with grinding materials, extending a plurality of rotatable spindle shafts into said tank displaced from said central axis and rotatable about axes parallel to the central axis, rotating work products to be ground on said spindle shafts and entered in said tank to contact said grinding materials, sealing the tank with a lid sealed thereon by a packing seal and adapted to rotate with the tank and thereby prevent loss of said grinding materials therein when subjected to flow patterns caused by rotation of the work products and high grinding pressures attained by centrifugal force afforded by the rotatable tank, and relatively rotating the work product on the spindle shafts and the grinding materials by rotating the tank and its sealed lid to achieve a grinding pressure within the tank bearing upon the work product as a result of flow of the grinding materials about the work product within the sealed tank.

2. The method defined in claim 1 including the step of rotating the tank at high speed to establish a centrifugal force within the tank to press the grinding materials against the inside wall of the tank and to flow in a rotary pattern around the work product at a high peripheral velocity.

3. Grinding apparatus comprising in combination, an open top grinding tank rotatable about a vertical axis for holding grinding materials, a movable stand carrying a tank cover adapted to rotate with the tank and comprising a packing seal for engaging the tank top about the upper rim when vertically moved into position thereby to seal the top of the tank, at least one rotatable spindle extending from the movable stand into said tank to rotate on a vertical axis off-center in said tank and adapted to hold work products to be ground, and means vertically moving the grinding tank and cover together into sealing engagement to permit the tank and cover to rotate together thereby to induce increased grinding pressure while preventing leakage of grinding materials from the tank when subjected to the increased grinding pressure afforded by flow patterns induced by the combined relative rotation of the work product on said spindle and centrifugal force acting on the grinding materials rotated with the covered tank.

4. The apparatus defined in claim 3 wherein the tank cover comprises a rotary disk with said packing seal and carried by said movable stand to engage said tank and rotate therewith.

5. The apparatus defined in claim 3 including separate means controlling rotation of the grinding tank and the spindle to thereby permit rotation of the tank and spindle independently in selected directions and at selected rotation speeds.

6. The apparatus defined in claim 3 wherein the means vertically moving the tank and stand together comprises a vertical lift moving the stand into and out of engagement with the tank, thereby to lower and lift the spindle.

* * * * *